United States Patent [19]

Cramer

[11] Patent Number: 4,665,629

[45] Date of Patent: May 19, 1987

[54] DRYER FOR PLASTIC GRANULES

[76] Inventor: Susanne Cramer, Bollwerkstrasse, 22, 5883 Kierspe 1, Fed. Rep. of Germany

[21] Appl. No.: 832,964

[22] Filed: Feb. 25, 1986

[51] Int. Cl.[4] ..... F26B 21/08

[52] U.S. Cl. ..... 34/54; 34/80; 55/208; 137/595

[58] Field of Search ..... 34/54, 80, 209, 214; 55/208; 137/595, 625.44, 625.4, 597

[56] References Cited

U.S. PATENT DOCUMENTS

| | | | |
|---|---|---|---|
| 3,621,878 | 11/1971 | Smith | 137/595 |
| 4,509,272 | 4/1985 | Graff | 34/54 |
| 4,553,423 | 11/1985 | Tanimoto | 137/595 |
| 4,584,781 | 4/1986 | Parkinson et al. | 34/92 |

OTHER PUBLICATIONS

Brochure of Peter Cramer "Drying Apparatus for Drying Granules of Plastic Composition by Means of Drying Air".

*Primary Examiner*—Albert J. Makay
*Assistant Examiner*—David W. Westphal
*Attorney, Agent, or Firm*—Mason, Kolehmainen, Rathburn & Wyss

[57] ABSTRACT

A dryer for plastic granules with a fan for air, with a drying chamber containing a regenerable desiccant, with a collecting duct connectable to the drying chamber for the drying air, with an air heating element in the collecting duct, with a plurality of drying containers connectable to the collecting duct, with a return duct from the drying containers to an inlet duct of the fan, with a first reversing valve, which connects in a first switching position the drying chamber with the collecting duct, and in a second switching position the drying chamber with the atmosphere, and with a second reversing valve, which connects in a first switching position the inlet duct of the fan to the return duct and in a second switching position the inlet duct to the atmosphere. One object is the reliable and synchronous reversing of the two reversing valves. Another object shall enable the coupling of further groups of drying container to one drying chamber. The two reversing valves are arranged in a common valve housing. Each reversing valve comprises in a valve chamber an inlet opening and two outlet openings situated side by side as well as a valve plate positioned on a lever arm of a lever, for the said outlet openings. The two levers are coupled by a coupling rod and are coupled to a pushing rod of a drive crank. Two separate collecting ducts and return ducts are coupled in each case to a branch nozzle.

7 Claims, 4 Drawing Figures

DRYER FOR PLASTIC GRANULES

BACKGROUND OF THE INVENTION

1. Field of the Invention

The present invention relates to a dryer for plastic granules with a fan for air, with a drying chamber containing a regenerable desiccant, with a collecting duct connectable to the drying chamber for the drying air, with an air heating element in the collecting duct, with a plurality of drying containers connectable to the collecting duct, with a return duct from the drying containers to an inlet duct of the fan, with a first reversing valve, which connects in a first switching position the drying chamber with the collecting duct, and in a second switching position the drying chamber with the atmosphere, and with a second reversing valve, which connects in a first switching position the inlet duct of the fan to the return duct and in a second switching position the inlet duct to the atmosphere.

2. Description of the Prior Art

Such a dryer allows the drying of granules in an energy-saving manner. The drying air flows in a closed cycle. The desiccant can be regenerated by hot air. For switching the different ducts, said two valves should be switched simultaneously. It is difficult to avoid a misswitching and errors in the duct connections.

Furthermore it is not possible to dry separate granules at different temperatures.

SUMMARY OF THE INVENTION

One object of the invention is the reliable and synchronous reversing of the two reversing valves.

A further object of the invention shall enable the coupling of further groups of drying container to one drying chamber.

This object is achieved in that the two reversing valves are arranged in a common valve housing, that each reversing valve comprises in a valve chamber an inlet opening and two outlet openings situated side by side as well as a valve plate positioned on a lever arm of a lever, for the said outlet openings, that the two levers are coupled by a coupling rod and are coupled to a pushing rod of a drive crank, and that two separate collecting ducts and return ducts are coupled in each case to a branch nozzle.

The placing of the two reversing valves in a common valve housing renders possible a coupling of the valve plates via a linkage and a reversing by a drive crank. Thereby a synchronous reversing is guaranteed so that any inadmissible duct connections for the air flow is not possible. It is secured that the drying air is always circulated in the closed cycle. On the other hand, during the regenerating phase the introduction of atmospherical air into the drying chamber is secured. This air is blown off again to the atmosphere together with the moisture absorbed during the regenerating of the desiccant. The connection of the collecting ducts and return ducts via branch nozzles enables the independent operation of a plurality of independent groups of drying containers in connection to one drying container.

By separately controllable air heating elements for each collecting duct it is possible to select the drying temperature of each group of drying containers independently of each other, so that the drying temperature can be adapted to different plastic granules.

For a secure movement of the valve plate the two outlet openings are provided in a plane wall of each valve chamber.

A tight closure of the valve openings is achieved in that each lever arm holds its valve plate under pretension against the outlet openings.

The switching positions are adjusted in that two diametrical positions of the drive crank correspond to the two switching positions of the reversing valves, and that a limit switch is associated with each of the said diametrical positions of the drive crank.

Furthermore each collecting duct comprises a separably controllable air heating element.

BRIEF DESCRIPTION OF THE DRAWINGS

A preferred embodiment of the invention will be described in the following with reference to the accompanying drawings, wherein.

DESCRIPTON OF THE PREFERRED EMBODIMENT

Figure 1:
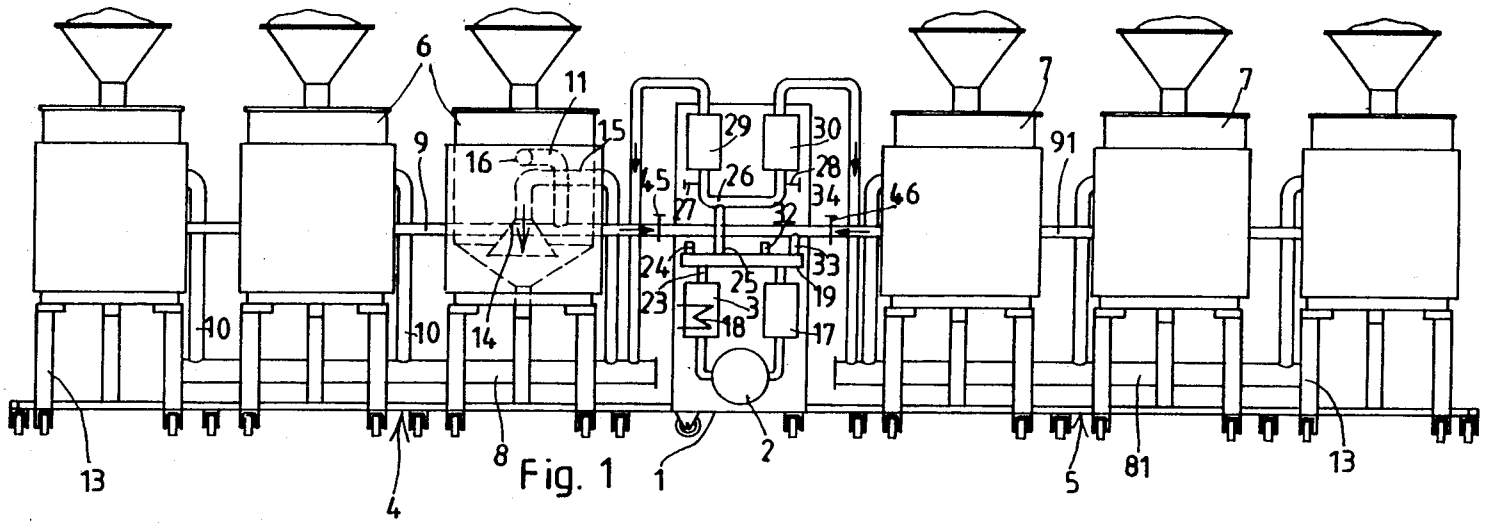
FIG. 1 is a schematic total view of a dryer plant.
Figure 2:
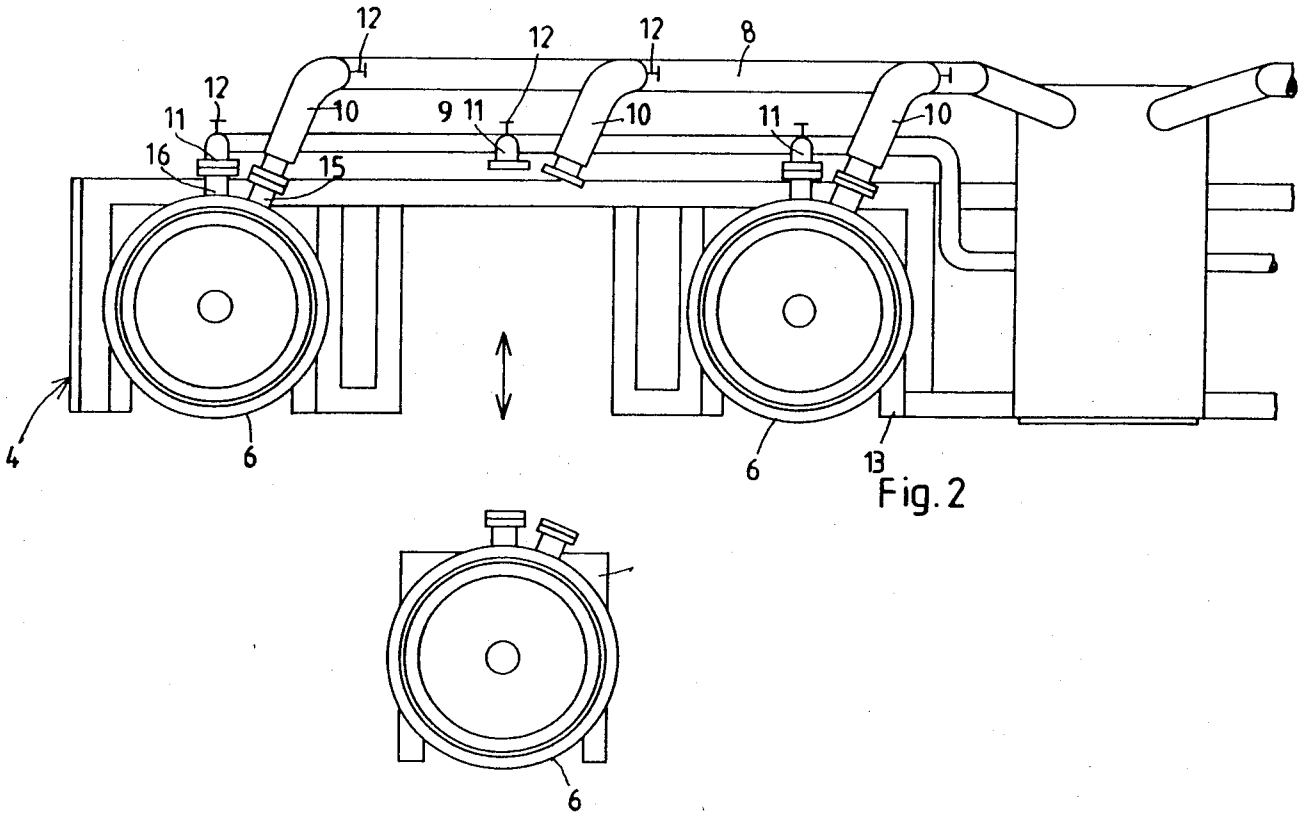
FIG. 2 is a partial top view in regard to FIG. 1.

The dryer plant according to FIG. 1 is mounted on a plurality of movable supporting stands. A first supporting stand 1 comprises a fan 2, a drying chamber 3, as well as further control devices, which will be described in detail lateron. Two supporting stands 4 and 5 are provided for the connection with drying containers 6 and 7 and receive in each case a collecting duct 8 or 81 and a return duct 9 or 91, each with connecting nozzles 10 and 11. Each connecting nozzle is equipped with a shut-off valve 12. Each supporting stand 1, 4 and 5 is movable on rollers. It is possible to couple the said supporting stands firmly to one another.

Each drying container 6 or 7 is arranged on a pallet 13. Each pallet 13 is movable on rollers. Each drying container 6, 7 has an insulating shell. An inlet funnel 14, which is connected to an inlet nozzle 15, is provided in the interior. An outlet nozzle 16 is provided in the upper part of the container shell. The drying container receives in each case plastic granules, which are to be dried. It is possible to couple the inlet nozzle 15 and the outlet nozzle 16 to a connecting nozzle 10 or 11.

Within the supporting stand 1 a dust filter 17 is arranged before the fan 2 . The drying chamber 3 is equipped with a heating 18 for the regeneration. A valve housing 19 contains, in separate valve chambers 20 and 21, two reversing valves. An inlet opening 22 of a duct 23, which comes from the drying chamber 3, leads into the valve chamber 20. Two outlet openings 24 and 25, situated side by side, are arranged on a plane area of the valve chamber 20. Outlet opening 24 leads to the atmosphere. The outlet opening 25 leads to a branch nozzle 26, to which, via shut-off valves 27 and 28 as well as air heating elements 29 and 30, the collecting ducts 8 and 81 are connected.

The second valve chamber 21 comprises an inlet opening 31, which leads to the dust filter 17. Two outlet openings 32 and 33, situated side by side, are arranged on a plane area of the valve chamber. The outlet opening 32 leads to the atmophere. The outlet opening 33 is connected to the return ducts 9 and 91 via a branch nozzle 34 as well as shut-off valves 45 and 46.

The structures of the reversing valves will be described in detail with reference to FIGS. 3 and 4. Each valve chamber 20, 21 carries, on a pin 35, 36, leading outwards, a lever 39, 40. A lever arm 37, 38 with a valve plate 41, 42 for the closing an opening 24, 25, or 32, 33, is provided in each case on the pins 35, 36, in the interior of the valve chamber 20, 21. Each valve plate 41, 42 is pretensioned by a tension spring 43 against the specific opening. The levers 39 and 40 are coupled by a coupling rod 44. The coupling rod 44 is coupled to a pushing rod 45 of a drive crank 46, which is driven by a gear motor 47. In two diametrical positions of the drive crank 46 in compliance with the end positions of the pushing rod 45 and, thus, the two switching positions of the valve plates 41, 42, two limit switches 48 and 49 are arranged. Said limited switches 48 and 49 define exact stop-positions of the gear motor 47 so that the respective valve openings are closed completly.

The functions of the dryer plant are described in the following:

Each supporting stand 4 and 5 incorporates a group of drying containers 6 or 7. The quantity of the drying containers of a group is not limited to three containers. There may also be more drying containers. The drying containers are movable on pallets 13 individually to the working position. The charging of the drying containers with plastic granules to be dried may be effected mechanically, pneumatically, or in another manner. A charging is possible also in the working position of the drying containers.

Figure 3:
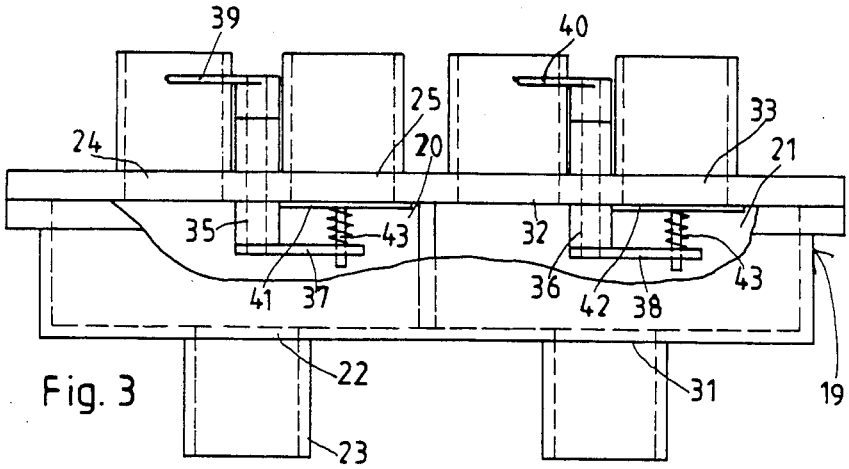
FIG. 3 is a broken up view of the reversing valves, whilst
Figure 4:
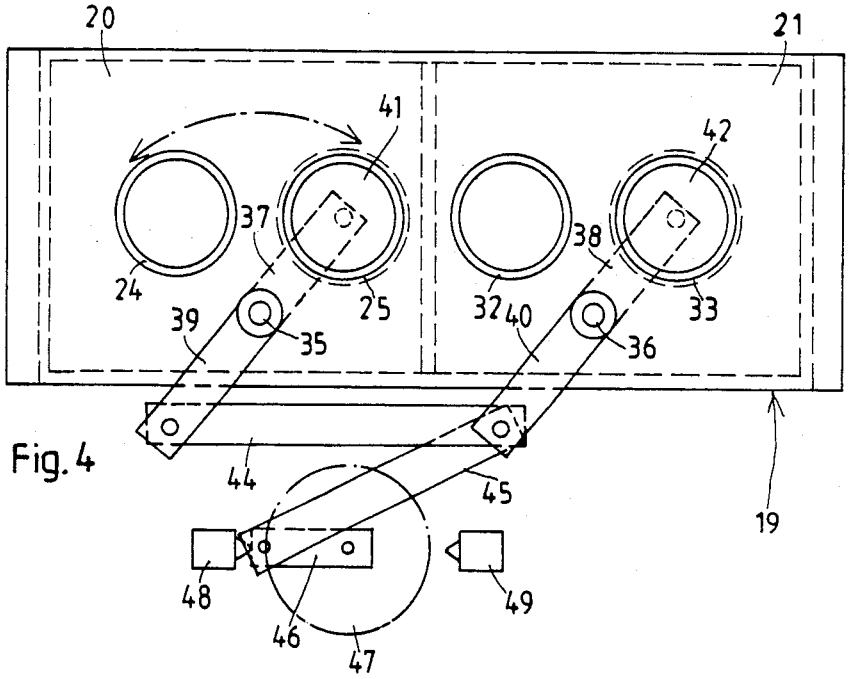
FIG. 4 shows a top view in regard to FIG. 3.

For the drying phase the reversing valves are reversed as compared with the switching position as shown in FIGS. 3 and 4, so that the outlet openings 24 and 32 are shut off. The switching can be effected by hand or by an automatic switching circuit.

The air is circulated by the fan 2 in a closed cycle. The air is dried in the drying chamber by the desiccant. A drying or dehumidification is possible to a dew point of −30° C. In the heating element 29 and 30, the air is heated to the desired temperature. The two groups of drying containers may be operated at different temperatures, dependent of the plastic granules. Then the hot air streams through the drying container and dehumidifies the plastic granules. The moisture then is given again to the desiccant.

For the regenerating of the desiccant, the reversing valves are reversed to the switching position, as shown in FIGS. 3 and 4, so that the outlet openings 25 and 33 are shut off. After the starting of the gear motor 47 same runs, until a switching off is effected by a limit switch 48 or 49. Thus, the reversing position is fixed in a reliable manner. Now the air is taken in from the atmosphere. In addition, the desiccant in the drying chamber 3 is heated by the heater 18 to a regeneration temperature of e.g. 250° C. Thereby the absorbed moisture by the desiccant is removed again. The air loaded with moisture is removed to the atmosphere via the outlet opening 24.

The synchronous operation of the two reversing valves eliminates a wrong duct directing. Consequently, it is not possible that, for example, moist regeneration air is blown into a drying container. it is also not possible that the closed drying cycle is interrupted. The connection of a plurality of groups of drying containers extends the working possibilities of a dryer plant according to the invention.

We claim the following:

1. A dryer for plastic granules comprising:

at least one drying container, a collecting duct connected to said drying container, a return duct connected to said drying container, providing drying air to chamber means for drying said plastic granules in said at least one drying container, said drying chamber having a valve chamber and a desiccant, first outlet opening means for selectively placing said valve chamber in communication with said collecting duct, second outlet opening means for selectively placing said valve chamber in communication with said return duct, third outlet opening means for selectively placing said valve chamber in communication with the atmosphere, first reversing valve means contained in said valve chamber and adapted to connect said drying chamber means to said collecting duct through said first outlet opening means and to the atmosphere through said third outlet opening means, second reversing valve means contained in said valve chamber and adapted to connect said drying chamber means to said return duct through said second outlet opening means and to the atmosphere through said third outlet opening means, and coupling means for coupling said first and second reversing valve means such that said first and second reversing valve means are mechanically interlocked whereby in one position of said first and second reversing valve means said drying chamber means is connected to said collecting duct through said first outlet opening means and to said return duct through said second outlet opening means so that the plastic granules are dried and in another position of said first and second reversing valve means said drying chamber means is connected to atmosphere through said third outlet opening means so that the desiccant is regenerated.

2. The dryer according to claim 1 wherein said first reversing valve means includes a first valve plate means and said second reversing valve means includes a second valve plate means, said first and second valve plate means being reciprocally mounted in said valve chamber in the same plane and wherein said first valve plate means selectively closes the first outlet opening means and said second valve plate means selectively closes said second outlet opening means.

3. The dryer according to claim 2 wherein said third outlet opening means includes first and second atmosphere outlet opening means and wherein said first valve plate means selectively closes said first atmosphere outlet opening means and said second valve plate means selectively closes said second atmosphere outlet opening means.

4. The dryer according to claim 3 wherein said first and second reversing valve means further include means for biasing said first valve plate means against said first outlet opening means and said first atmosphere outlet opening means and said second valve plate means against said second outlet opening means and said second atmosphere outlet opening means.

5. A dryer according to claim 1 further including limit switches actuated by said first and second reversing valve means for providing a signal representative of the position of said first and second reversing valve means.

6. A dryer according to claim 1 further including separably controllable air heating elements in said collecting duct.

7. A dryer according to claim 1 wherein said drying chamber includes a fan wwhich communicates with said return duct.

* * * * *